US005361920A

United States Patent [19]

Nozawa et al.

[11] Patent Number: 5,361,920

[45] Date of Patent: Nov. 8, 1994

[54] CAP STRUCTURE WITH ELASTIC TURNOVER COVER

[75] Inventors: Takamitsu Nozawa, Suginami; Takaharu Tasaki, Koto, both of Japan

[73] Assignee: Yoshino Kogyosho Co., Ltd., Tokyo, Japan

[21] Appl. No.: 107,164

[22] Filed: Aug. 17, 1993

Related U.S. Application Data

[63] Continuation of Ser. No. 828,895, Feb. 3, 1992, abandoned.

[30] Foreign Application Priority Data

Jun. 16, 1989 [JP] Japan ..... 1-70424[U]
Jul. 27, 1990 [JP] Japan ..... 2-80392[U]

[51] Int. Cl.[5] ..... B65D 43/14

[52] U.S. Cl. ..... 215/237; 215/235; 220/339

[58] Field of Search ..... 215/235, 237; 220/335, 220/339; 222/498, 517, 556

[56] References Cited

U.S. PATENT DOCUMENTS

| | | | |
|---|---|---|---|
| 4,334,639 | 6/1982 | Gach | 222/153 |
| 4,403,712 | 9/1983 | Wiesinger | 220/339 |
| 4,545,495 | 10/1985 | Kinsley | 215/235 |
| 4,638,916 | 1/1987 | Beck et al. | 215/235 |
| 4,793,502 | 12/1988 | Beck | 215/235 |
| 4,795,044 | 1/1989 | Beck | 215/237 |
| 4,848,612 | 7/1989 | Beck | 215/235 |
| 4,854,473 | 8/1989 | Dubach | 215/235 |
| 5,115,931 | 5/1992 | Dubach | 215/235 |

FOREIGN PATENT DOCUMENTS

| | | |
|---|---|---|
| 21801/83 | 5/1985 | Australia . |
| 58800/86 | 1/1987 | Australia . |
| 15607/88 | 11/1988 | Australia . |
| 0291457 | 11/1988 | European Pat. Off. . |
| 0345403 | 12/1989 | European Pat. Off. . |
| 0385078 | 9/1990 | European Pat. Off. . |
| 2633590 | 1/1990 | France . |
| 62-216354 | 1/1987 | Japan . |
| 63-34049 | 3/1988 | Japan . |
| 2224309 | 5/1990 | United Kingdom . |

*Primary Examiner*—Allan N. Shoap
*Assistant Examiner*—Nova Stucker
*Attorney, Agent, or Firm*—Oliff & Berridge

[57] ABSTRACT

A cap structure having an elastic turnover cover. Body 1 of the cap structure is closed at the top of its first circumferential wall 2 with a cover 5 having a second circumferential wall 7 depending from the outer circumference of its top wall 6 by placing the lower end of the second circumferential wall 7 on the upper end of the first circumferential wall 2. The first and second circumferential walls 2 and 7 have their individual backs connected at their upper and lower ends by a hinge 10. The upper and lower portions of the backs of the first and second circumferential walls 2,7 are so connected through an elastic band 12 that the cover 5 can be opened or closed by the hinge 10. The hinge 10 is integrally molded of a synthetic resin at the back of the elastic band 12. This eliminates notches as a mold parting mark, which might otherwise be left in the cover when the cap structure of this kind is to be integrally molded of a synthetic resin in accordance with the prior art.

4 Claims, 5 Drawing Sheets

CAP STRUCTURE WITH ELASTIC TURNOVER COVER

This is a continuation of application Ser. No. 07/828,895 filed Feb. 3, 1992, now abandoned.

TECHNICAL FIELD

The present invention relates to a cap structure having an elastic turnover cover. The "cap structure" used herein is meant to include a cap and a container with a cap.

BACKGROUND ART

As a cap having an elastic turnover cover, there is known a cap which is integrally molded of a synthetic resin and having its cap body and cover hinged at three points, as is used in the container of Japanese Utility Model Laid-Open No. 34049/1988, for example. This cap is formed by integrally connecting a cap body and a cap opening cover into one piece by means of the three-point hinge. This three-point hinge structure is composed of: first two spaced hinges for connecting respective circumferential walls of the cap body and the cover placed thereon; an elastic band provided between the first two hinges; and second and third hinges for connecting each end of the elastic band to the cap body and the cover. The elastic band is formed into an L-shape such that it extends from the circumferential wall of the cap body to the top wall of the cover.

In order that the three-point hinged cap may be integrally molded of a synthetic resin, both the circumferential wall and the top wall of the cover are notched in accordance with the shape of the corresponding part of the elastic band for parting the mold. However, the notch on the top wall deteriorates the appearance of the cover. Even worse, the notch prevents the cover from completely sealing up the mouth of the cap body with the cover.

In order to eliminate the defects of the aforementioned example of the prior art, the present invention contemplates providing a cap structure having elastic bands which can be formed only at the respective circumferential walls of the cap body and the cover without notching the top wall of the cover, so that the cover may have an improved appearance and may seal up the mouth of the cap body in the closed position.

Disclosure of the Invention

In an embodiment shown in FIGS. 1 to 5, if a cover 5 is pushed up from the open state of FIG. 5, a first end 12*b* of a curved elastic band 12 is allowed to move along an arc b which has a radius of a straight distance from the hinges 10 to the first end 12*b*, since the cover is turned on the hinges 10. Accordingly, the first end 12*b* deviates from an arc a, which has a radius of a straight distance from a second end 12*a* of the elastic band to the first end 12*b*. As a result, the elastic band 12 is extended against its elasticity until a dead center A defined by a point of intersection between the arc b and a straight line c containing the second end 12*a* and the hinges 10. And then, the elastic band is shrunken after the dead center A by its elastic controlling force so that the cover 5 is elastically turned over to establish the closed state. The cover opening operation could be likewise understood.

Incidentally, the elastic band 12 may have its intermediate portion curved to the front in the closed state of FIG. 4.

Another embodiment shown in FIGS. 6 to 8 is similar to the foregoing first embodiment.

A similar discussion applies to the case of a third embodiment shown in FIGS. 9 to 11. In this embodiment, each elastic band 12 is curved in a letter "C" not only in the open state but also in the closed state, in which it is received in a recess 13. According to this embodiment, the elastic bands 12 can be prevented from being forcibly extended more than their limits even when they pass through the dead center A at which they are extended to their maximum strokes.

BRIEF DESCRIPTION OF THE DRAWINGS

Of FIGS. 1 to 5 showing one embodiment of the cap structure of the present invention.

Figure 6:
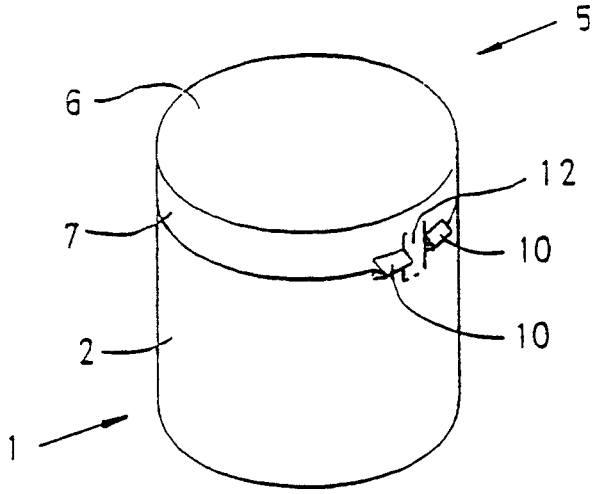
Figure 7:
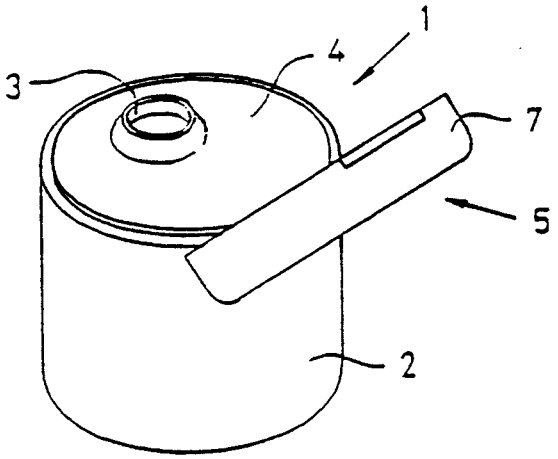
Figure 8:
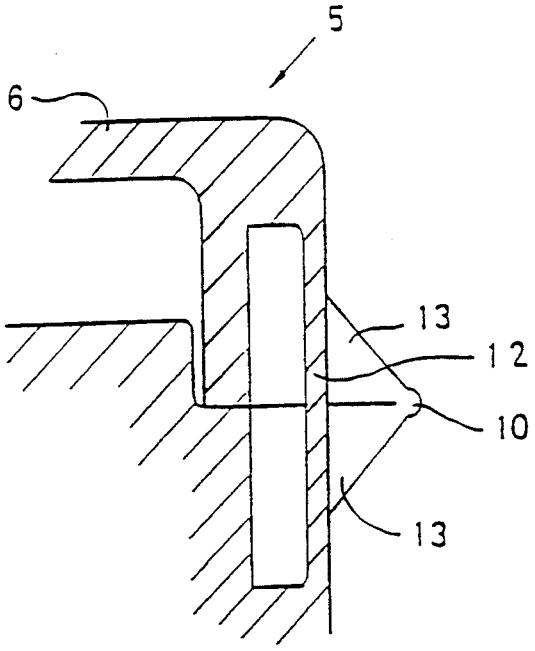

Of FIGS. 6 to 8 showing a second embodiment:

FIG. 6 is a perspective view showing the closed state from the back;

FIG. 7 is a perspective view showing the open state; and

FIG. 8 is an enlarged section showing an essential portion.

Figure 9:
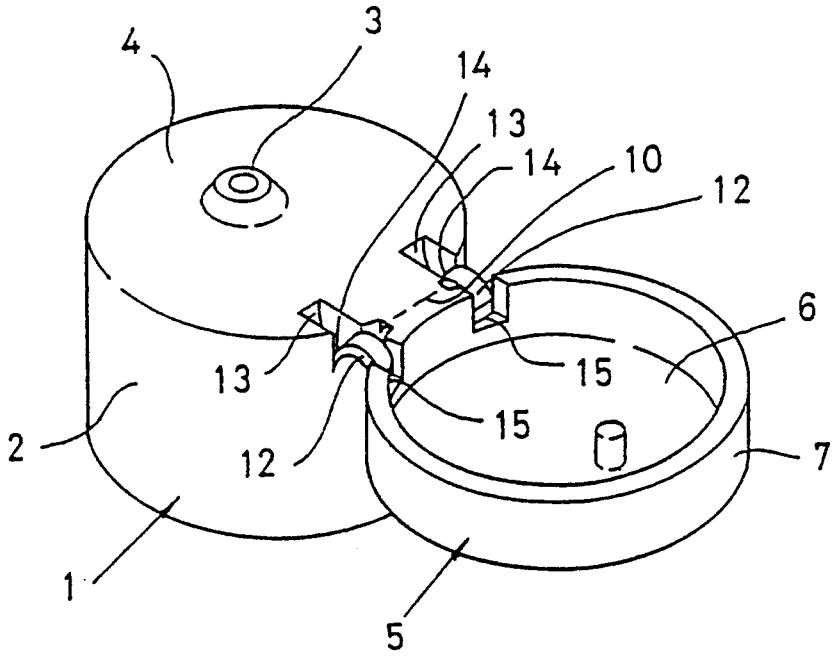
Figure 10:
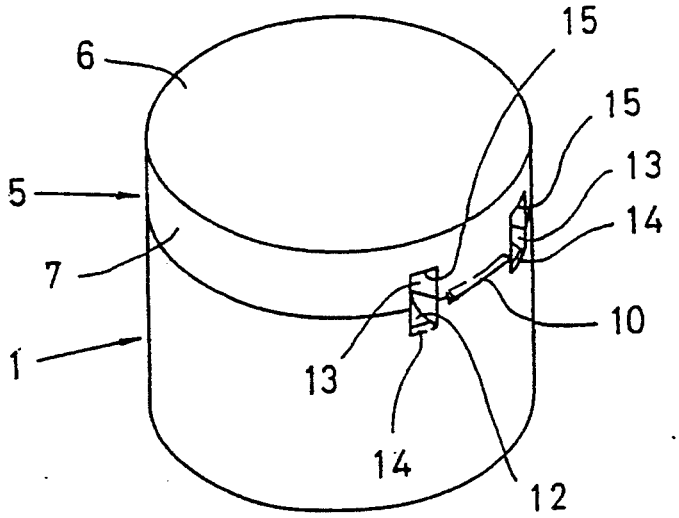
Figure 11:
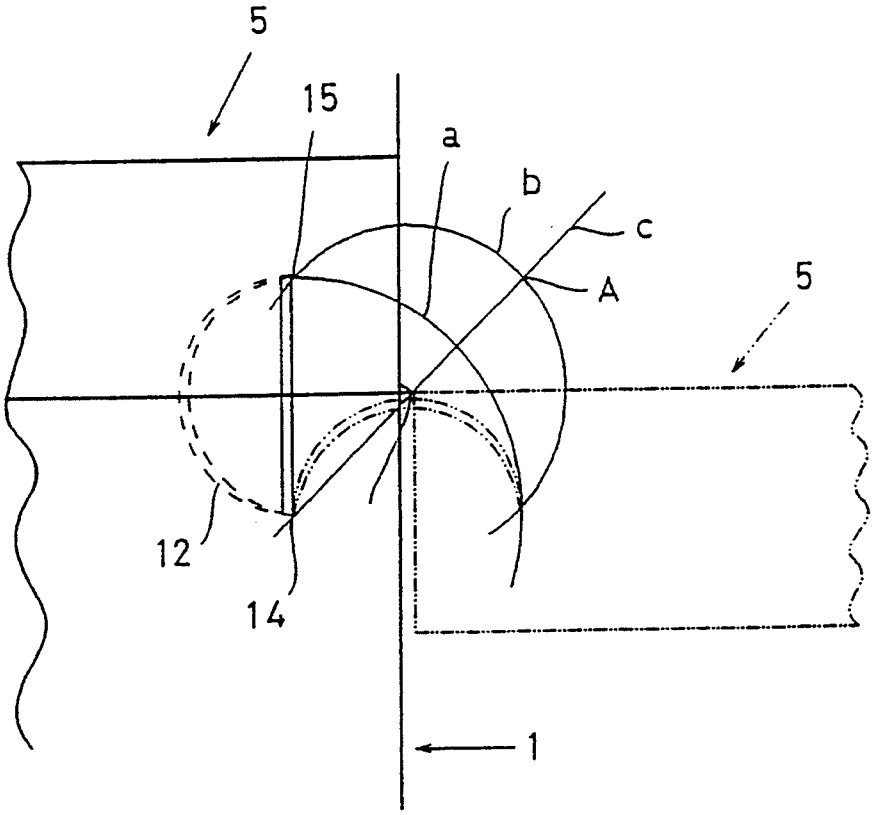

Of FIGS. 9 to 11 showing a third embodiment:

FIG. 9 is a perspective view showing the open state;

FIG. 10 is a perspective view showing the closed state from the back; and

FIG. 11 is an enlarged side elevation showing an essential portion.

BEST MODE FOR CARRYING OUT THE INVENTION

First of all, the first embodiment will be described with reference to FIGS. 1 to 5.

Reference numeral 1 designates the body of a cap structure having a first circumferential wall 2. This first circumferential wall 2 is adapted to be fitted on the outer circumference of the neck of a container, when the body 1 is a cap. However, this first circumferential wall has its lower end shut out with a bottom wall when the cap structure is a container body. In the shown embodiment, the first circumferential wall 2 has its top covered with a top plate 4 having a pouring port 3, but this top plate 4 can be eliminated.

Indicated at reference numeral 5 is a cover which is molded, of polyethylene or the like, integrally with the aforementioned body 1. This cover 5 can be turned on later-described hinges to open or close the top of the outer circumference. In the cover 5, a second circumferential wall 7 depends from the outer circumference of a top wall 6 and can have its lower end placed on the upper end of the first circumferential wall 2. The first circumferential wall 2 and the second circumferential wall 7 are shaped into a true circle, as seen in a top plan view, and have their backs formed into a vertical wall 8 which in turn is formed with a groove 9 at its widthwise center.

Figure 1:
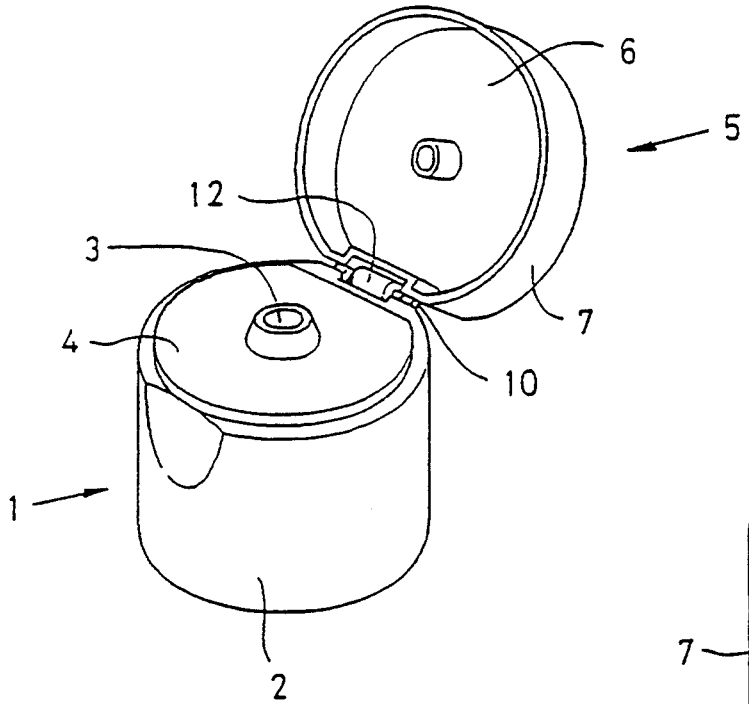
FIG. 1 is a perspective view showing the open state.
Figure 2:
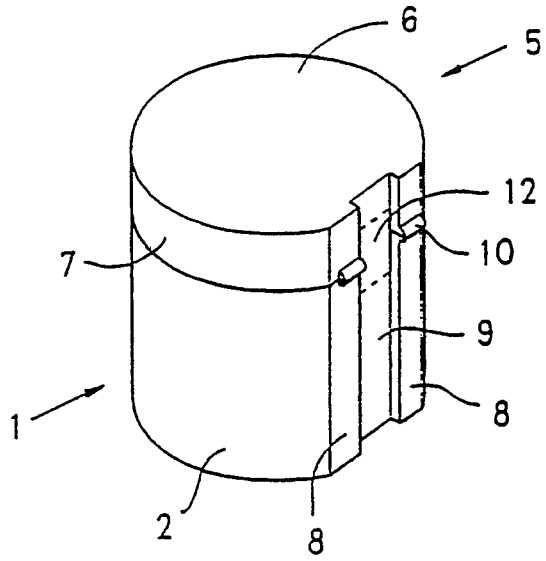
FIG. 2 is a perspective view showing the closed state from the back.
Figure 3:
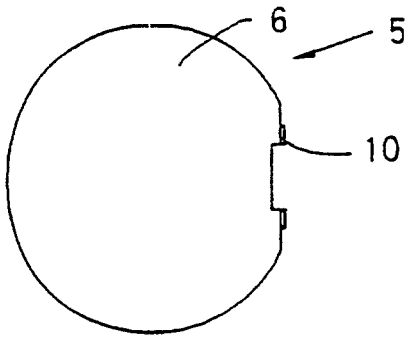
FIG. 3 is a top plan view showing the same.
Figure 4:
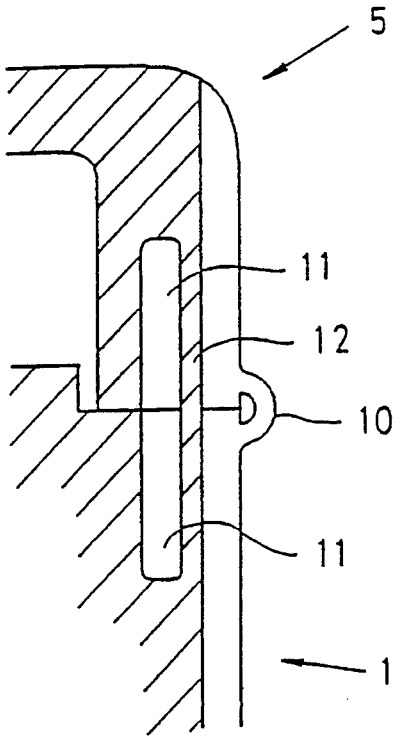
FIG. 4 is an enlarged section showing an essential portion.
Figure 5:
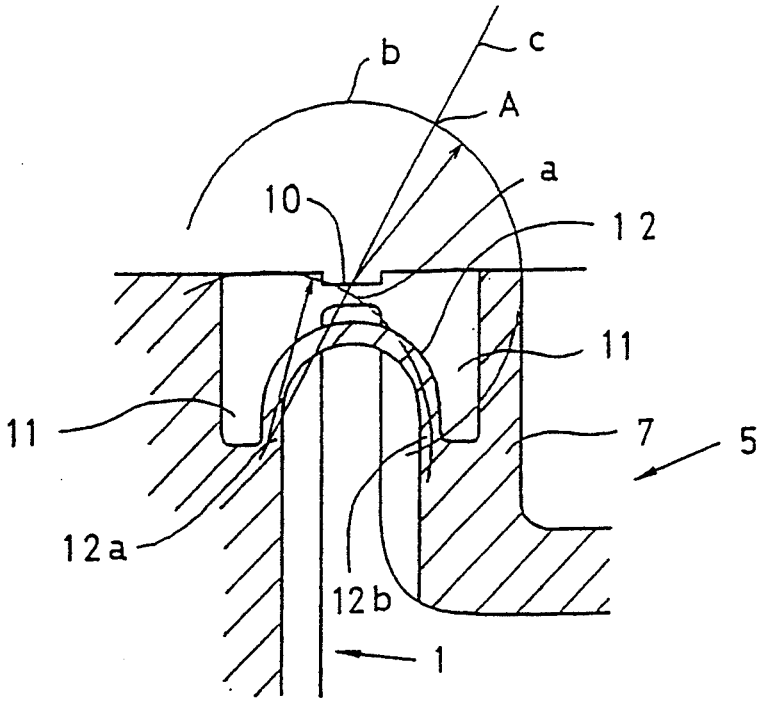
FIG. 5 is an enlarged section showing an essential portion in the open state.

The vertical walls 8 of the first and second circumferential walls 2 and 7, which are divided by the groove 9, have their respective upper and lower ends connected by curved hinges 10 and 10, as better seen from FIG. 4. Moreover, the upper end of a groove bottom of the first circumferential wall and the lower end of a groove bottom of the second circumferential wall are formed to merge into each other, and the first and second circumferential walls are formed in front of their merging portions with holes 11 and 11, which are extended downward and upward from the upper and lower ends of the individual circumferential walls to leave an elastic band 12 at the bottom of the groove 9 at the back of the holes 11 and 11. This elastic band 12 is preliminarily curved such that the body 1 and the cover 5 are integrally molded of a synthetic resin such as polyethylene, as shown in FIG. 5, with the cover 5 being opened with respect to the body 1 and with the elastic band 12 being curved upward. The connecting portions between the upper and lower ends of the elastic band 12 and the second and first circumferential walls are so formed that they cannot be bent angularly.

The second embodiment, as shown in FIGS. 6 to 8, is not formed with the aforementioned vertical walls 8 and groove 9 of the foregoing first embodiment. In this second embodiment, the first and second circumferential walls 2 and 7, which are shaped into a true circle in a top plan view, are connected by a pair of hinges 10, 10 provided at the righthand and lefthand portions of the respective backs thereof. Each of the hinges is formed at leading ends of triangular projections 13 and 13 provided at the upper and lower ends of the first and second circumferential walls. Moreover, the elastic band 12 is extended through an interval of the hinges 10 and 10 and so tensioned between the lower part of the first circumferential wall and the upper part of the second circumferential wall. The upper and lower ends merge into the two circumferential walls in an unbendable manner. As in the first embodiment, the second embodiment has its cap structure molded with the body and the cover in the closed state.

FIGS. 9 to 11 show the third embodiment. In this embodiment, the first and second circumferential walls 2 and 7 having a top plan view of a true circle are connected at their rear upper and lower ends by the hinge 10 and at the righthand and lefthand sides of the hinge 10 by a pair of C-shaped elastic bands 12 and 12. These elastic bands are fitted in recesses 13, which are formed to extend between the upper and lower portions of the individual backs of the first and second circumferential walls 2 and 7. The recesses 13 have their lower end rear edges and upper end rear edges connected to the lower and upper ends of the elastic bands 12 through second and third hinges 14 and 15.

Like the foregoing other embodiments, the third embodiment is also formed in the open state, as shown in FIG. 9.

Industrial Applicability

According to the construction thus far described, the cap structure of the present invention can be prevented from having its appearance deteriorated because it has no notch and can have its body top sealed up by the cover. Unlike the three-point hinged cap of the prior art, the elastic plates need not be mounted by notching the back of the circumferential wall of the cover and the top wall of the cover partially. In the structure of the third embodiment, moreover, the elastic bands are given the C-shaped longitudinal sections so that they can have their cover side ends passing over the dead centers while leaving a margin of further elastic deformations. Since, moreover, the C-shaped elastic bands are fitted in the recesses 13 formed in the backs of the first and second circumferential walls of the body and the cover when in the closed state, the elastic bands will not deteriorate the appearance of the cap structure.

We claim:

1. A snap-type cap structure made of synthetic resin, comprising:

a body having a first circumferential wall;

a cover having a second circumferential wall being placable on said first circumferential wall, said first and second circumferential walls being connected to each other by a first hinge having two sides;

a pair of first recesses provided in the first circumferential wall, one adjacent each of said two sides of said first hinge;

a pair of second recesses provided in the second circumferential wall, said second recesses being aligned with said first recesses;

an elastic band fitted in each aligned set of first and second recesses, and connecting said first and second circumferential walls;

wherein each of said elastic bands is connected to opposite ends of said first and second recesses through a second hinge and a third hinge at respective ends of each of said bands, with said second and third hinges being positioned at outer circumferential edges of said first and second recesses in a closed state, said elastic bands are curved into said first and second recesses from the outer circumferential edges thereof, so as to have C-shaped sections in the closed state and in a fully open state in which said cover is turned over and, the elastic bands are adapted to be non-linearly deformed from an original C-shaped section shape in the closed state through a deformed shade at an equilibrium state located between the closed state and the fully open state and then restored to the same original C-shaped section shape by elasticity at the fully open state, said deformation increasing from the closed state to the equilibrium state and decreasing from the equilibrium state to the fully open state.

2. A cap structure in accordance with claim 1, wherein the length of said elastic bands in the closed state is not less than a linear distance between said second and third hinges when said elastic bands are in said equilibrium state.

3. A cap structure in accordance with claim 1, wherein said body includes securement means for securement to an open mouth of a container.

4. A cap structure in accordance with claim 1, wherein said body is a container and said first circumferential wall forms an open mouth.

* * * * *

UNITED STATES PATENT AND TRADEMARK OFFICE

CERTIFICATE OF CORRECTION

PATENT NO. : 5,361,920

DATED : November 8, 1994

INVENTOR(S) : Takamitsu NOZAWA; Takaharu TASAKI

It is certified that error appears in the above-indentified patent and that said Letters Patent is hereby corrected as shown below:

Column 4,

Claim 1, line 31, change "shade" to --shape--.

Signed and Sealed this

Eighth Day of August, 1995

Bruce Lehman

*Attest:*

BRUCE LEHMAN

*Attesting Officer*

*Commissioner of Patents and Trademarks*